US010811177B2

(12) United States Patent
Doris et al.

(10) Patent No.: US 10,811,177 B2
(45) Date of Patent: Oct. 20, 2020

(54) STRESS CONTROL IN MAGNETIC INDUCTOR STACKS

(71) Applicant: International Business Machines Corporation, Armonk, NY (US)

(72) Inventors: Bruce B. Doris, Hartsdale, NY (US); Hariklia Deligianni, Alpine, NJ (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 10 days.

(21) Appl. No.: 15/197,866

(22) Filed: Jun. 30, 2016

(65) Prior Publication Data

US 2018/0005741 A1 Jan. 4, 2018

(51) Int. Cl.

| | |
|---|---|
| ***H01F 3/02*** | (2006.01) |
| ***H01F 3/10*** | (2006.01) |
| ***H01F 41/04*** | (2006.01) |
| ***H01F 17/00*** | (2006.01) |
| ***H01F 10/16*** | (2006.01) |
| ***H01F 10/26*** | (2006.01) |

(Continued)

(52) U.S. Cl.

CPC ..... *H01F 3/02* (2013.01); *H01F 7/20* (2013.01); *H01F 10/16* (2013.01); *H01F 10/265* (2013.01); *H01F 17/0013* (2013.01); *H01F 41/0233* (2013.01); *H01F 41/046* (2013.01); *H01F 41/22* (2013.01); *H01F 2017/0066* (2013.01)

(58) Field of Classification Search

CPC ..... H01F 3/02; H01F 3/10

See application file for complete search history.

(56) References Cited

U.S. PATENT DOCUMENTS

| | | | | |
|---|---|---|---|---|
| 4,640,871 A | | 2/1987 | Hayashi et al. | |
| 5,032,945 A | * | 7/1991 | Argyle | B82Y 25/00 360/125.39 |

(Continued)

FOREIGN PATENT DOCUMENTS

| | | | | |
|---|---|---|---|---|
| CN | 104485325 A | | 4/2015 | |
| JP | 06036934 A | * | 2/1994 | H01F 17/00 |

(Continued)

OTHER PUBLICATIONS

Bruce B. Doris, et al., Pending U.S. Appl. No. 15/196,640 entitled, "Stress Control in Magnetic Inductor Stacks," filed with the U.S. Patent and Trademark Office on Jun. 29, 2016.

(Continued)

*Primary Examiner* — Elvin G Enad
*Assistant Examiner* — Malcolm Barnes
(74) *Attorney, Agent, or Firm* — Cantor Colburn LLP

(57) ABSTRACT

A magnetic laminating structure and process for preventing substrate bowing include a first magnetic layer, at least one additional magnetic layer, and a dielectric spacer disposed between the first and at least one additional magnetic layers. The magnetic layers are characterized by defined tensile strength. To balance the tensile strength of the magnetic layer, the dielectric layer is selected to provide compressive strength so as to counteract the tendency of the wafer to bow as a consequence of the tensile strength imparted by the magnetic layer(s).

7 Claims, 2 Drawing Sheets

(51) Int. Cl.

| | |
|---|---|
| ***H01F 41/22*** | (2006.01) |
| ***H01F 7/20*** | (2006.01) |
| ***H01F 41/02*** | (2006.01) |

(56) References Cited

U.S. PATENT DOCUMENTS

| | | | | |
|---|---|---|---|---|
| 6,346,336 | B1 * | 2/2002 | Nago | B82Y 25/00 204/192.2 |
| 7,107,666 | B2 | 9/2006 | Hiatt et al. | |
| 7,463,131 | B1 | 12/2008 | Hwang et al. | |
| 7,719,084 | B2 | 5/2010 | Gardner et al. | |
| 7,723,827 | B2 | 5/2010 | Katoh | |
| 7,867,787 | B2 | 1/2011 | Gardner et al. | |
| 8,102,236 | B1 | 1/2012 | Fontana, Jr. et al. | |
| 8,717,136 | B2 | 5/2014 | Fontana, Jr. et al. | |
| 8,754,500 | B2 * | 6/2014 | Webb | H01L 23/5227 257/531 |
| 9,047,890 | B1 * | 6/2015 | Herget | G11B 5/39 |
| 9,064,628 | B2 | 6/2015 | Fontana, Jr. et al. | |
| 9,697,948 | B2 * | 7/2017 | Osada | H01L 23/5225 |
| 9,882,121 | B2 | 1/2018 | Kuo et al. | |
| 10,304,603 | B2 | 5/2019 | Doris et al. | |
| 2002/0130386 | A1 | 9/2002 | Acosta et al. | |
| 2003/0029520 | A1 * | 2/2003 | Ingvarsson | B82Y 25/00 148/108 |
| 2003/0209295 | A1 * | 11/2003 | Cooper | H01F 10/16 148/311 |
| 2005/0093437 | A1 * | 5/2005 | Ouyang | H01L 51/5281 313/506 |
| 2007/0297101 | A1 | 12/2007 | Inomata et al. | |
| 2008/0003699 | A1 * | 1/2008 | Gardner | H01F 41/046 438/3 |
| 2009/0219754 | A1 * | 9/2009 | Fukumoto | B82Y 25/00 365/158 |
| 2010/0014178 | A1 * | 1/2010 | Okami | G02B 5/205 359/888 |
| 2010/0087066 | A1 * | 4/2010 | O'Sullivan | B82Y 25/00 438/754 |
| 2011/0001202 | A1 | 1/2011 | Gardner | |
| 2011/0175193 | A1 | 7/2011 | Nakagawa | |
| 2012/0236528 | A1 * | 9/2012 | Le | H05K 9/0088 361/818 |
| 2012/0299137 | A1 * | 11/2012 | Worledge | B82Y 25/00 257/421 |
| 2013/0106552 | A1 | 5/2013 | Fontana, Jr. et al. | |
| 2013/0224887 | A1 * | 8/2013 | Lee | C23C 14/0617 438/3 |
| 2013/0314192 | A1 | 11/2013 | Fontana, Jr. et al. | |
| 2013/0316503 | A1 | 11/2013 | Doris et al. | |
| 2014/0021426 | A1 | 1/2014 | Lee et al. | |
| 2014/0061853 | A1 | 3/2014 | Webb | |
| 2014/0190003 | A1 | 7/2014 | Fonatana, Jr. et al. | |
| 2014/0216939 | A1 * | 8/2014 | Fontana, Jr. | C25D 7/123 205/50 |
| 2014/0239443 | A1 * | 8/2014 | Gallagher | C23C 18/1834 257/531 |
| 2014/0339653 | A1 | 11/2014 | Chang et al. | |
| 2014/0363701 | A1 * | 12/2014 | Hu | G11B 5/62 428/832 |
| 2015/0097267 | A1 | 4/2015 | Tseng et al. | |
| 2015/0171157 | A1 * | 6/2015 | Sturcken | H01L 23/5223 257/531 |
| 2015/0207060 | A1 * | 7/2015 | Schuller | H01L 43/08 257/421 |
| 2017/0256708 | A1 | 9/2017 | Towfick et al. | |
| 2018/0005740 | A1 | 1/2018 | Doris et al. | |
| 2019/0035523 | A1 * | 1/2019 | Kou | B32B 27/281 |
| 2019/0221346 | A1 | 7/2019 | Doris | |

FOREIGN PATENT DOCUMENTS

| | | | |
|---|---|---|---|
| JP | 0636934 | A | 6/1994 |
| JP | 2006178395 | A | 7/2006 |
| JP | 2010080774 | A | 4/2010 |
| JP | 5096278 | B2 | 12/2012 |

OTHER PUBLICATIONS

List of IBM Patents or Patent Applications Treated As Related; (Appendix P), Date Filed Jan. 2, 2018; 2 pages.

Notification of Transmittal of the International Search Report and the Written Opinion of the International Searching Authority, or the Delcaration, issued in PCT/IB2017/052694 dated Sep. 1, 2017; 12 pages.

* cited by examiner

STRESS CONTROL IN MAGNETIC INDUCTOR STACKS

BACKGROUND

The present invention relates to on-chip magnetic devices, and more specifically, to on-chip magnetic structures and methods for relieving stress and preventing wafer bowing.

On-chip magnetic inductors/transformers are important passive elements with applications in the fields such as on-chip power converters and radio frequency (RF) integrated circuits. In order to achieve high energy density, magnetic core materials with thickness ranging several 100 nm to a few microns are often implemented. For example, in order to achieve the high energy storage required for power management, on-chip inductors typically require relatively thick magnetic yoke materials (several microns or more).

There are two basic configurations, closed yoke and solenoid structure inductors. The closed yoke has copper wire with magnetic material wrapped around it and the solenoid inductor has magnetic material with copper wire wrapped around it. Both inductor types benefit by having very thick magnetic materials. One issue with depositing thicker materials is stress. Stress can cause wafers to bow and the bow can cause issues with lithography alignment and wafer chucking on processing tools. Stress for magnetic materials like CoFeB for example can be about 200 to about 400 megapascals (MPa). However, since the total magnetic film thickness requirement is greater than 1 micrometer (μm), the wafer bow can be considerably high.

Ferrite materials that are often used in bulk inductors have to be processed at high temperature (>800° C.), which is generally incompatible with complementary metal-oxide-semiconductor (CMOS) processing. Thus, a majority of magnetic materials integrated on-chip are magnetic metals such as nickel iron (Ni—Fe), cobalt iron (Co—Fe), cobalt iron boron (Co—Fe—B), cobalt zirconium titanium (Co—Zr—Ti) and the like.

SUMMARY

Exemplary embodiments include inductor structures and methods for forming the inductor structures In one or more embodiments, the inductor structure includes a plurality of metal lines; and a laminated film stack comprising alternating layers of magnetic materials and insulating materials enclosing the metal lines, each magnetic material layer having a tensile stress and each insulation material layer having a compressive stress, wherein the compressive stress of the insulating material layer is in an amount effective to counterbalance the tensile stress of the magnetic material layer, wherein the layers of the magnetic materials have a cumulative thickness greater than 1 micron.

In one or more embodiments, a method of forming an inductor structure includes depositing alternating magnetic and insulating layers on a processed substrate, wherein the magnetic layers have a tensile strength and the insulating layers have a compressive strength in an amount effective to counterbalance the tensile stress of the magnetic layers, wherein the magnetic layers have a cumulative thickness greater than 1 micron.

In one or more embodiments, an inductor structure includes alternating magnetic and insulating layers on a processed substrate, wherein the magnetic layers have a tensile stress and the insulating layers have a compressive stress in an amount effective to counterbalance the tensile stress of the magnetic layers, wherein each of the insulating layers has a thickness greater than each of the magnetic layers, wherein the magnetic layers have a cumulative thickness greater than 1 micron.

In one or more embodiments, a closed yoke inductor includes a laminated structure including alternating magnetic and insulating layers on a processed substrate, wherein the magnetic layers have a tensile strength and the insulating layers have a compressive strength in an amount effective to counterbalance the tensile stress of the magnetic layers, wherein the magnetic layers have a cumulative thickness greater than 1 micron; and a copper wire, wherein the laminated structure is wrapped around the laminated structure.

In one or more embodiments, a solenoid inductor includes a laminated structure comprising alternating magnetic and insulating layers on a processed substrate, wherein the magnetic layers have a tensile strength and the insulating layers have a compressive strength in an amount effective to counterbalance the tensile stress of the magnetic layers, wherein the magnetic layers have a cumulative thickness greater than 1 micron; and a copper wire wrapped about the laminated structure.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Disclosed herein are on chip magnetic inductor structures and methods for relieving stress as a function of the relatively thick magnetic layers utilized therein. The magnetic inductor structures and methods generally include formation of a stress balanced laminated magnetic stack structure and method for forming the laminated structure. An insulating layer is intermediate adjacent magnetic layers and has a compressive stress value effective to counterbalance the tensile stress value of the magnetic layers. Embodiments of a laminated magnetic material for inductors in integrated circuits and the method of manufacture thereof will be described.

Figure 1:
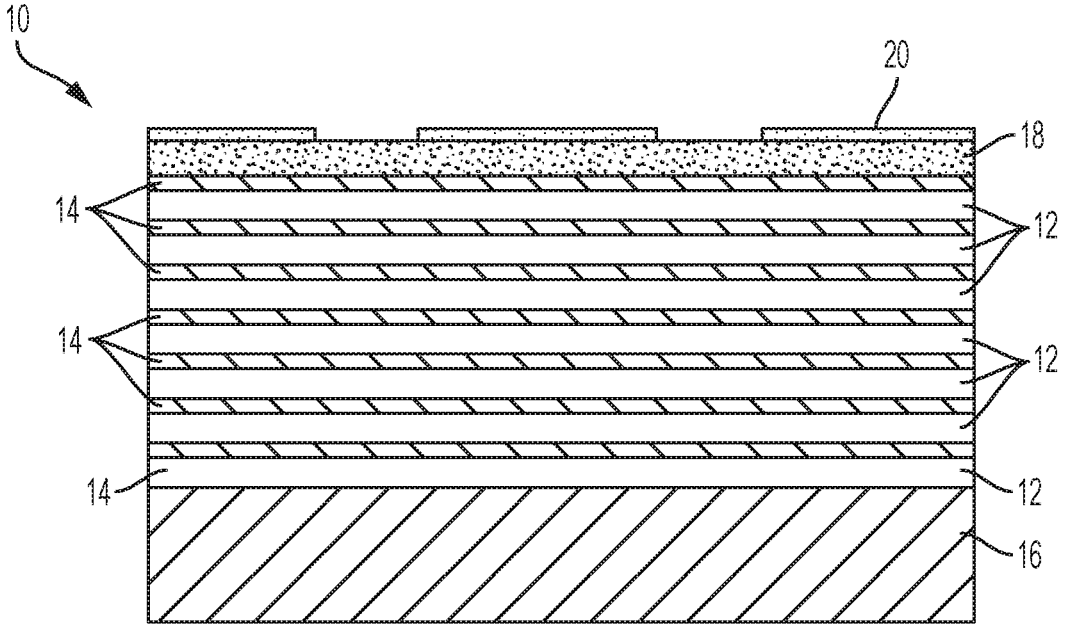
FIG. 1 illustrates a cross section of an inductor structure in accordance with the present invention.

Turning now to FIG. 1, there is depicted a cross section of an exemplary inductor structure in accordance with the present invention. The inductor structure 10 generally includes a plurality of alternating magnetic layers 12 and insulating layers 14 disposed on a processed wafer 16. Once the desired number of magnetic layers has been deposited, which typically provides a total magnetic layer thickness greater than 1 micron to several microns, a hard mask 18 is provided for additional processing to complete the device.

For example, a resist image 20 can be lithographically formed to provide additional structures and connections.

A "processed wafer" is herein defined as a wafer that has undergone semiconductor front end of line processing (FEOL) middle of the line processing (MOL), and back end of the line processing (BEOL), wherein the various desired devices and circuits have been formed.

The typical FEOL processes include wafer preparation, isolation, well formation, gate patterning, spacer, extension and source/drain implantation, silicide formation, and dual stress liner formation. The MOL is mainly gate contact formation, which is an increasingly challenging part of the whole fabrication flow, particularly for lithography patterning. The state-of-the-art semiconductor chips, the so called 14 nm node of Complementary Metal-Oxide-Semiconductor (CMOS) chips, in mass production features a second generation three dimensional (3D) FinFET, a metal one pitch of about 55 nm and copper (Cu)/low-k (and air-gap) interconnects. In the BEOL, the Cu/low-k interconnects are fabricated predominantly with a dual damascene process using plasma-enhanced CVD (PECVD) deposited interlayer dielectric (ILDs), PVD Cu barrier and electrochemically plated Cu wire materials.

Each of the magnetic layers 14 in the laminate stack can have a thickness of about 100 nanometers or more and typically has a tensile stress value of about 50 to about 400 MPa. Tensile stress is a type of stress in which the two sections of material on either side of a stress plane tend to pull apart or elongate. In contrast, compressive stress is the reverse of tensile stress, wherein adjacent parts of the material tend to press against each other through a typical stress plane.

The magnetic layers 14 can be deposited through vacuum deposition technologies (i.e., sputtering) or electrodepositing through an aqueous solution. Vacuum methods have the ability to deposit a large variety of magnetic materials and to easily produce laminated structures. However, they usually have low deposition rates, poor conformal coverage, and the derived magnetic films are difficult to pattern. Electroplating has been a standard technique for the deposition of thick metal films due to its high deposition rate, conformal coverage and low cost.

The magnetic layers are not intended to be limited to any specific material and can include CoFe, CoFeB, CoZrTi, CoZrTa, CoZr, CoZrNb, CoZrMo, CoTi, CoNb, CoHf, CoW, FeCoN, FeCoAlN, CoP, FeCoP, CoPW, CoBW, CoPBW, FeTaN, FeCoBSi, FeNi, CoFeHfO, CoFeSiO, CoZrO, CoFeAlO, combinations thereof, or the like. Inductor core structures from these materials have generally been shown to have low eddy losses, high magnetic permeability, and high saturation flux density.

Figure 3:
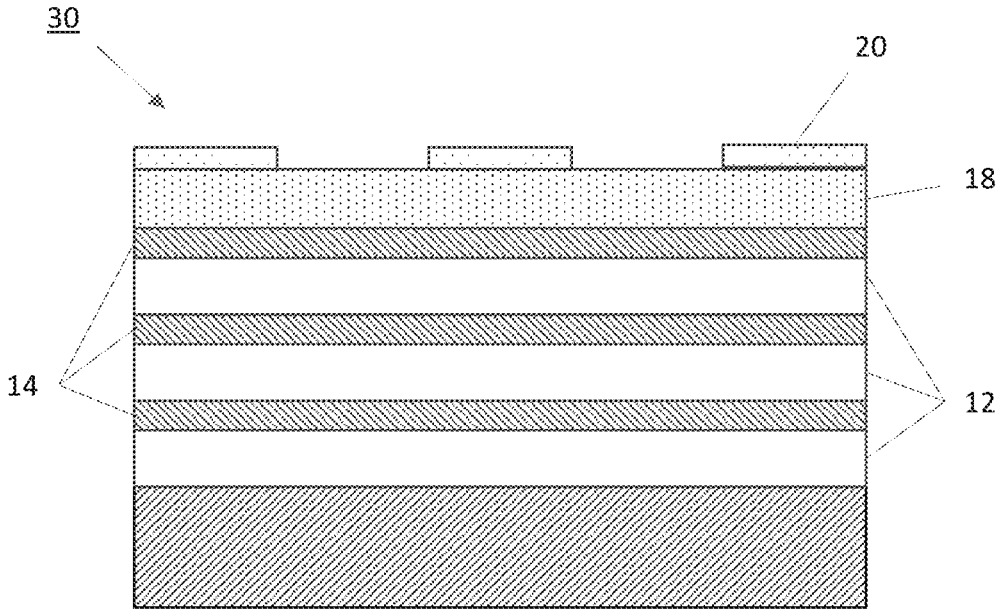
FIG. 3 illustrates a cross section of an inductor structure in accordance with the present invention

The insulating layer 14 is not intended to be limited to any specific material and can include dielectric materials such as silicon dioxide (SiO2), silicon nitride (SiN), silicon oxynitride (SiOxNy), magnesium oxide (MgO), aluminum oxide (AlO2), or the like. The bulk resistivity and the eddy current loss of the magnetic structure can be controlled by the insulating layer. The thickness of the insulating layer 16 should be minimal and is generally at a thickness effective to electrically isolate the magnetic layer upon which it is disposed from other magnetic layers in the film stack. Generally, the insulating layer has a thickness of about 1 nanometer to about 500 nanometers and is about one half or more of the magnetic layer thickness as is generally shown in the inductor structure 30 of FIG. 3.

The thickness and stress of the insulating layer 16 are optimized to counterbalance the wafer bowing caused by the presence of the tensile stress within the magnetic material. Thus, the insulating layer generally serves two primary purposes. One purpose is to isolate the magnetic material from each other in the stack and the other purpose is to counterbalance the unwanted wafer bow produced by the magnetic material. As noted above, the thickness of the insulating layer is generally about one half of the magnetic material.

In one or more embodiments, the compressive stress of the insulating layer 16 at a particular thickness is within 20% of the tensile stress of the first magnetic layer at a particular thickness but of an opposite magnitude (i.e., negative versus positive stress). By way of example, if the magnetic layer has a tensile stress of 200 MPa at a given thickness, the insulating material is selected and configured to have a compressive stress of −160 MPa to −240 MPa. In one or more embodiments, the compressive stress of the insulating layer is at about half the thickness of the magnetic layer. In one or more other embodiments, the compressive stress of the insulating layer is within 10% of the tensile stress of the magnetic layer. By way of example, if the magnetic layer has a tensile stress of 200 MPa, the insulating material is selected and configured to have a compressive stress of −180 MPa to −220 MPa. In one or more embodiments, the compressive stress of the insulating layer is at about an equal magnitude to the first magnetic layer albeit compressive in nature.

In one or more embodiments the thickness of the dielectric material is larger and with opposite sign stress compared to the magnetic material. The thickness of the dielectric material is used to balance the stress of the magnetic material. Thus for example if the magnetic material is about 400 MPa tensile and 100 nm in thickness then the dielectric material can be 200 MPa compressive and about 200 nm in thickness or 100 MPa compressive and about 400 nm in thickness or some other combination of stress and thickness to balance the stress in the magnetic material. In one or more other embodiments, the dielectric has higher magnitude and opposite sign stress compared to the magnetic material and would be thinner to counter balance the stress due to the magnetic material. In one or more other embodiments, the magnetic material is selected to have a compressive stress and the dielectric material is selected to have a tensile stress. In or more other embodiments, the magnetic material is selected to be neutral in terms of stress and the dielectric material is selected to be neutral in terms of stress as well.

The insulating layer can be deposited using a deposition process, including, but not limited to, PVD, CVD, PECVD, or any combination thereof. The deposition parameters are known to control the stress within the insulating material, which for some materials can vary between tensile stress and compressive stress depending on the deposition parameters. For example, by changing the duty cycle of two different plasma excitation frequencies during deposition, the stress of silicon nitride deposited at 300° C. can be controlled in a wide range from compressive to tensile. The magnitude of stress as well as the type of stress, e.g., compressive or tensile, can be readily measured using known techniques, e.g., laser induced diffraction imaging methods. A conventional wafer bow measurement tool as is available in the industry can be used to measure film stress on a full 200 mm or 300 mm wafer.

The inductor including the laminate structure as described can be integrated in a variety of devices. A non-limiting example of inductor integration is a transformer, which can include metal lines (conductors) formed parallel to each other by standard silicon processing techniques directed to forming metal features. The inductor structures can be formed about the parallel metal lines to form a closed magnetic circuit and to provide a large inductance and magnetic coupling among the metal lines. The inclusion of the magnetic material and the substantial or complete enclosure of the metal lines can increase the magnetic coupling between the metal lines and the inductor for a given size of the inductor. Inductors magnetic materials are also useful for RF and wireless circuits as well as power converters and EMI noise reduction.

Figure 2:
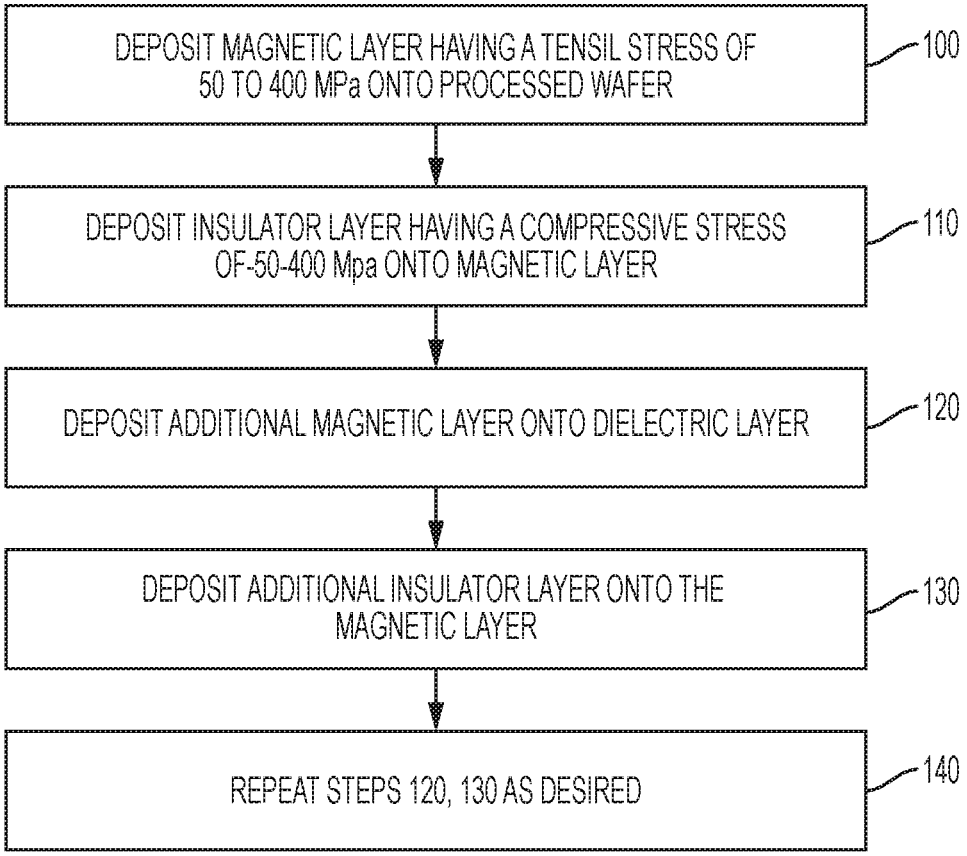
FIG. 2 depicts a process flow diagram in accordance with the present invention

Referring now to FIG. 2, the process of forming the on chip magnetic inductor is shown and generally begins with depositing a magnetic layer onto the processed wafer as shown in step 100, which after FEOL, MOL, and BEOL processing has a planar uppermost surface. The magnetic layer 12 is deposited onto the processed wafer 16.

In step 110, an insulating layer 14 is then deposited onto the magnetic material layer 12. The insulating layer has a compressive stress as described above.

Next, as shown in step 120, at least one additional magnetic layer 12 is deposited onto the insulating layer 14. The at least one additional magnetic layer 12 can be the same or different relative to other magnetic layers within the laminate structure. Likewise, the tensile stress value can be the same or different. In addition, the thickness can be the same or different. By way of example, the film thickness can be about 100 nanometers and can have a tensile stress of about 50 to about 400 MPa.

In step 130, at least one additional insulating layer 14 is deposited onto the at least one additional magnetic layer 12. The at least one additional insulating layer 14 can be the same or different relative to other insulating layers within the laminate structure but is selected to provide a compressive stress value as described above. The compressive stress value can be the same or different. In addition, the thickness can be the same or different.

As shown in step 140, the deposition of the at least one magnetic layer and the at least one additional dielectric layer can be repeated until the desired inductor stack is formed, which includes a magnetic film having a total thickness in excess of 1 micron to several microns. By utilizing a laminate structure including insulating layers having a compressive stress value between magnetic layers having a tensile stress value, wafer bowing can be prevented.

Once the desired laminate structure is formed, the process can further include deposition of a hard mask onto the laminate structure followed by lithography to complete the device, wherein lithography can then be performed without alignment issues due to wafer bowing.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated It should be apparent that there can be many variations to this diagram or the steps (or operations) described herein without departing from the spirit of the invention. For instance, the steps can be performed in a differing order or steps can be added, deleted or modified. All of these variations are considered a part of the claimed invention.

While the preferred embodiment to the invention had been described, it will be understood that those skilled in the art, both now and in the future, can make various improvements and enhancements which fall within the scope of the claims which follow. These claims should be construed to maintain the proper protection for the invention first described.

What is claimed is:

1. An inductor structure comprising:

a laminated film stack comprising alternating layers of sputter deposited magnetic materials and insulating materials, each magnetic material layer having a tensile stress and each insulation material layer having a compressive stress, wherein the compressive stress of the insulating material layer is within 20 percent of the tensile stress of the magnetic material layer, wherein the layers of the magnetic materials have a cumulative thickness greater than 1 micron, wherein the insulating layer has a compressive stress value having an opposite sign equivalent to a value of the magnetic tensile stress, wherein each of the insulator material layers has a thickness of about one half of a thickness of each of the magnetic material layers and the compressive stress of each of the insulating layers is about two times higher than a magnitude of the tensile stress associated with the magnetic material, and wherein the magnetic material is selected from the group consisting of CoZrTi, CoZr, CoZrMo, CoTi, CoNb, CoHf, CoW, FeCoN, FeCoAlN, CoP, FeCoP, CoPW, CoBW, CoPBW, FeTaN, FeCoBSi, CoFeHfO, CoFeSiO, CoZrO and CoFeAlO.

2. The inductor structure of claim 1, wherein the magnetic layers have a tensile stress value in a range from 50 to 400 megapascals.

3. The inductor structure of claim 1, wherein the insulator materials are selected from the group consisting of silicon nitride, silicon oxynitride, magnesium oxide and aluminum oxide.

4. The inductor structure of claim 1, wherein the insulator material layers have a compressive stress of −50 to −400 megapascals for thicknesses at about one half the thickness for each of the magnetic material layers.

5. The inductor structure of claim 1, wherein the magnetic layers have a tensile stress of about zero and the insulating layer is selected to have a compressive stress of about zero.

6. The inductor structure of claim 1, wherein the magnetic material layers have a thickness of 50 nanometers to 100 nanometers.

7. The inductor structure of claim 1, wherein the insulator material layers have a compressive stress value having the opposite sign greater than the tensile stress value of the magnetic material layer.

* * * * *